US006787493B1

(12) United States Patent
Nagaoka et al.

(10) Patent No.: US 6,787,493 B1
(45) Date of Patent: Sep. 7, 2004

(54) BIODEGRADABLE FORMABLE FILAMENT NONWOVEN FABRIC AND METHOD OF PRODUCING THE SAME

(75) Inventors: Koichi Nagaoka, Uji (JP); Fumio Matsuoka, Uji (JP); Naoji Ichise, Uji (JP)

(73) Assignee: Unitika, Ltd., Hyogo-Ken (JP)

( * ) Notice: Subject to any disclaimer, the term of this patent is extended or adjusted under 35 U.S.C. 154(b) by 0 days.

(21) Appl. No.: 09/324,368

(22) Filed: Jun. 2, 1999

Related U.S. Application Data

(63) Continuation-in-part of application No. 08/715,900, filed on Sep. 19, 1996, now abandoned.

(30) Foreign Application Priority Data

| | | |
|---|---|---|
| Sep. 29, 1995 | (JP) | 7-251679 |
| Oct. 3, 1995 | (JP) | 7-256079 |
| Oct. 3, 1995 | (JP) | 7-256080 |
| Oct. 3, 1995 | (JP) | 7-256083 |

(51) Int. Cl.[7] ..... D04H 13/00
(52) U.S. Cl. ..... 442/414; 442/417
(58) Field of Search ..... 442/414, 417; 428/543

(56) References Cited

U.S. PATENT DOCUMENTS 6,607,996 B1 * 8/2003 Matsunaga et al. ..... 442/327

FOREIGN PATENT DOCUMENTS

| | | | |
|---|---|---|---|
| EP | 0 530 987 A1 | | 3/1993 |
| EP | 0 597 427 A1 | | 5/1994 |
| EP | 0 637 641 A1 | | 6/1994 |
| EP | 0 671 496 A1 | | 9/1995 |
| EP | 765959 | * | 9/1996 |
| FR | 2725731 | * | 4/1996 |
| JP | 9-95851 | * | 9/1987 |
| JP | 5-214648 | | 8/1993 |
| JP | 6-212511 | | 8/1994 |
| JP | 6-212548 | | 8/1994 |
| JP | 6-264343 | | 9/1994 |
| JP | 7-034369 | | 2/1995 |
| JP | 7-048769 | | 2/1995 |
| JP | 7-125128 | | 5/1995 |
| JP | 7-126970 | | 5/1995 |
| JP | 7-133511 | | 5/1995 |
| JP | 8-246320 | | 9/1996 |
| JP | 9-95849 | * | 4/1997 |
| JP | 9-95850 | * | 4/1997 |
| WO | WO 98/50611 | * | 11/1998 |

OTHER PUBLICATIONS

Electronic Translation of JP 07–133511, May 1995.*
CAPLUS AN 1995:733612, abstracting JP 07–133511.*
Patent Abstracts of Japan, JP 7–126970; Japanese Patent Office (c) 1995.
Patent Abstracts of Japan, JP 6–212511; Japanese Patent Office (c) 1994.
Patent Abstracts of Japan, JP 7–048769; Japanese Patent Office (c) 1995.
Patent Abstracts of Japan, JP 6–264343; Japanese Patent Office (c) 1994.
A. Khan, L. Wadsworth, and C. Ryan, "Polymer–Laid Nonwovens From Poly (Lactide) Resin", International Nonwovens Journal, vol. 7, No. 2, 69–73, 1995.
European Search Report, EPO Form 1503 (P04C01), dated Jan. 23, 1997 and mailed Feb. 4, 1997.
English Abstract of JP 8–246320 and for EP 0 637 641 A1; Published in Dialog File 351 by Derwent Information Ltd (C) 1995.

* cited by examiner

*Primary Examiner*—Jeffrey Mullis
(74) *Attorney, Agent, or Firm*—Linda M. Deschere; Harness, Dickey, Pierce, P.L.C.

(57) ABSTRACT

A formable biodegradable filament nonwoven fabric and a production method therefor are provided. A biodegradable polymer comprising a thermoplastic aliphatic polyester as its principal component is melted and extruded through a spinneret into filaments. While being quenched with quench air blow, the extruded filaments are drafted at a drafting speed of 1,000 to 2,500 m/min by means of a suction device disposed below the spinneret. The drafted filaments are spread and accumulated on a movable collector surface thereby to be formed into a web, which is then treated for formation of a nonwoven fabric. The constituent filaments of the nonwoven fabric has a polymer supercool index of 0.3 to 0.6.

12 Claims, 3 Drawing Sheets

BIODEGRADABLE FORMABLE FILAMENT NONWOVEN FABRIC AND METHOD OF PRODUCING THE SAME

CROSS-REFERENCE TO RELATED APPLICATIONS

This is a continuation-in-part of application Ser. No. 08/715,900, filed Sep. 19, 1996 now abandoned.

FIELD OF THE INVENTION

The present invention relates to a formable filament nonwoven fabric which is biodegradable by microorganisms and the like in natural environments, and a method of producing the same.

BACKGROUND OF THE INVENTION

Hitherto, nonwoven fabrics which are degradable by microorganisms have been known, examples thereof including degradable nonwoven fabrics composed of natural or regenerated fibers or filaments such as of cotton, flax, hemp, ramie, wool, rayon, chitin and alginic acid.

However, such degradable nonwoven fabrics, which are generally hydrophilic and water absorptive, are not suitable for use in such an application as disposable diaper top sheet which should have hydrophobic and less water absorptive properties and provide a dry tactile feeling even in a wet or moistened state. These nonwoven fabrics are much liable to deterioration in strength and dimensional stability under wet and moistened environmental conditions and, hence, find limited application in the general industrial material field. Further, these nonwoven fabrics are not thermoformable because of their non-thermoplastic property and, hence, are inferior in processability.

Therefore, positive research and development have recently been made on microbially degradable filaments which are obtainable by the melt spinning technique from microbially degradable polymers having thermoplastic and hydrophobic properties, and on microbially degradable nonwoven fabrics composed of such filaments. In particular, a group of polymers generally called aliphatic polyesters are attracting high attention because they are microbially degradable. Specific examples of such polymers include poly-β-hydroxyalkanoates as typical microbially degradable polyesters, poly-ω-hydroxyalkanoates such as polycaprolactone, polyalkylene dicarboxylates such as polybutylene succinate which are polycondensates of a glycol and a dicarboxylic acid, and copolymers of these polymers. In recent development of a new polymerization process which ensures efficient production of polymers of high polymerization degree, various attempts have been made to produce filaments from poly-α-hydroxyacids such as poly-L-lactic acid and nonwoven fabrics composed of such filaments. Of the aforesaid aliphatic polyesters, polylactic acid in particular has a relatively high melting point, so that nonwoven fabrics composed of polylactic acid filaments are possibly useful in applications which require heat resistance. Therefore, much expectation is now directed toward practical application of the polylactic acid nonwoven fabrics.

A variety of products, such as disposable food trays, bottles and pots, molded or formed from these biodegradable polymers through an injection molding process, a blow molding process, a compression thermoforming process or the like have been under study, and some of these products have been put into practical use.

Although the products molded or formed through these processes are rigid and superior in shape retaining property, the processes are not suitable for production of filters, plant pots and the like which require air permeability and liquid permeability, nor for production of shoulder pads, masks, caps, hats and the like which require fibrous texture and softness. In the compression thermoforming process, a sheet material is employed which has a high stiffness, so that it is difficult to efficiently form the sheet material into a complicated configuration. In addition, the products thus molded or formed have smaller specific surface areas per unit polymer weight and, hence, have low biodegradation rates in composting.

DISCLOSURE OF THE INVENTION

It is an object of the present invention to provide a formable biodegradable filament nonwoven fabric which can be formed into a complicated configuration and composted in an extremely short time, and is applicable to products which require air permeability and liquid permeability.

In accordance with one aspect of the present invention to accomplish this object, there is provided a thermoformable nonwoven fabric composed of filaments of a biodegradable polymer which comprises a thermoplastic aliphatic polyester as its principal component, wherein the filaments have a polymer supercool index of 0.3 to 0.6.

In accordance with another aspect of the present invention, there is provided a method of producing a thermoformable nonwoven fabric composed of filaments of a biodegradable polymer comprising a thermoplastic aliphatic polyester as its principal component, the method comprising the steps of: melting the polymer and extruding the resulting melt through a spinneret into filaments; drafting the extruded filaments at a drafting speed of 1,000 to 2,500 m/min by means of a suction device disposed below the spinneret, while quenching the filaments with quench air blow; spreading and accumulating the drafted filaments on a movable collector surface thereby to form a web; and treating the web for formation of the nonwoven fabric.

In accordance with the present invention, the nonwoven fabric is formed of the filaments which are obtained by drafting the extruded filaments at a drafting speed of 1,000 to 2,500 m/min under quenching below the spinneret and thereby have a polymer supercool index of 0.3 to 0.6. Therefore, the nonwoven fabric maintains a sufficient filament mobility during a thermoforming process, particularly, when subjected to a complicated acute-angle forming process. In addition, the nonwoven fabric has a low distortion stress and a high breaking extension at a thermoforming temperature. Therefore, breakage of the nonwoven fabric is effectively prevented, which may otherwise occur during the thermoforming process. Further, products thermoformed from the filament nonwoven fabric have a larger specific surface area than products thermoformed from conventional sheet materials and, therefore, can be composted in an extremely short time. Further, the filament nonwoven fabric of the present invention can be formed into products which require air permeability and liquid permeability and products which require fibrous or nonwoven texture.

DETAILED DESCRIPTION OF THE INVENTION

Figure 1:
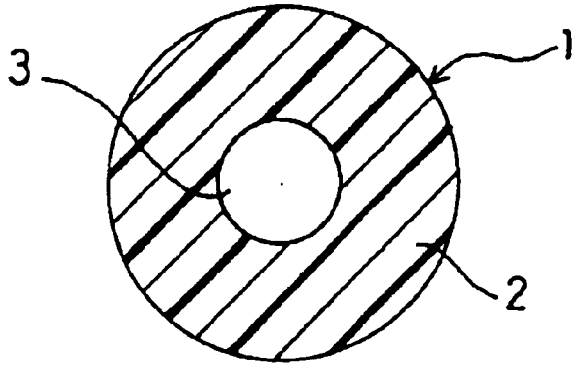
FIGS. 1 through 6 are diagrams illustrating exemplary cross-sectional configurations of constituent filaments of nonwoven fabrics in accordance with the present invention.

Filaments to be employed in the present invention are composed of a biodegradable polymer comprising a thermoplastic aliphatic polyester as its principal component.

Examples of the thermoplastic aliphatic polyester include: poly-α-hydroxy acids such as polyglycolic acid and polylactic acid, and copolymers comprising a base unit of any of these polymers; poly-ω-hydroxyalkanoates such as poly-ε-caprolactone and poly-β-propiolactone, and poly-β-hydroxyalkanoates such as poly-3-hydroxypropionate, poly-3-hydroxybutyrate, poly-3-hydroxycapronate, poly-3-hydroxyheptanoate and poly-3-hydroxyoctanoate, and copolymers comprising a base unit of any of these polymers and a base unit of poly-3-hydroxyvalerate or poly-4-hydroxybutyrate; and polycondensates of a glycol and a dicarboxylic acid, such as polyethylene oxalate, polyethylene succinate, polyethylene adipate, polyethylene azelate, polybutylene oxalate, polybutylene succinate, polybutylene adipate, polybutylene sebacate, polyhexamethylene sebacate and polyneopentyl oxalate, and polyalkylene dicarboxylate copolymers comprising a base unit of any of these polymers.

In the present invention, particularly preferred among the aforesaid polymers in terms of biodegradability, spinnability and the like are: polylactic acid based polymers; polybutylene succinate, polyethylene succinate, polybutylene adipate and polybutylene sebacate, and copolymers essentially comprising a base unit of any of these polymers; and polycaprolactone and polypropiolactone, and copolymers essentially comprising a base unit of any of these polymers.

Where a polylactic acid based polymer is employed as the aliphatic polyester, the polylactic acid based polymer is selected from the group consisting of poly-D-lactic acid, poly-L-lactic acid, copolymers of D-lactic acid and L-lactic acid, copolymers of D-lactic acid and hydroxycarboxylic acid, copolymers of L-lactic acid and hydroxycarboxylic acid, and copolymers of D-lactic acid, L-lactic acid and hydroxycarboxylic acid which have melting points of not lower than 100° C., and blends of any of these polymers.

Where a homopolymer such as poly-D-lactic acid or poly-L-lactic acid is used as the polylactic acid based polymer, it is desirable that a plasticizer be added thereto particularly for enhancement of spinnability in the spinning process and improvement of flexibility of the resulting filaments and nonwoven fabric. Examples of the plasticizer include triacetin, lactic acid oligomers, and dioctyl phthalate. The amount of the plasticizer to be added is 1 to 30 wt %, preferably 5 to 20 wt %.

In the present invention, it is preferred, in terms of the heat resistance of the resulting nonwoven fabric, that the constituent filaments of the nonwoven fabric have a melting point of not lower than 100° C. Therefore, the polymer forming the filaments preferably has a melting point of not lower than 100° C., more preferably, not lower than 120° C. The polylactic acid homopolymer such as poly-L-lactic acid or poly-D-lactic acid, for example, has a melting point of about 180° C. Where one of the aforesaid copolymers is used as the polylactic acid-based polymer, the copolymerization molar ratio of monomeric components thereof is preferably determined so that the copolymer has a melting point of not lower than 100° C., more preferably, not less than 120° C. In the copolymer, the copolymerization molar ratio of either one of L-lactic acid and D-lactic acid needs be 90% or more and that of the other is 10% or less. If the ratio is out of this specified range, the melting point of the polylactic acid based polymer and hence the melting point of the constituent filaments of the nonwoven fabric are lower than 100° C., or the resulting copolymer is an amorphous polymer. Accordingly, the quenchability of the filaments in the spinning process is lowered, and the resulting nonwoven fabric has a lower heat resistance. This imposes limitations on applications of the nonwoven fabric.

Where a copolymer of L- or D-lactic acid and a hydroxycarboxylic acid is used, examples of specific hydroxycarboxylic acids include glycolic acid, hydroxybutyric acid, hydroxyvaleric acid, hydroxypentanoic acid, hydroxycaproic acid, hydroxyheptanoic acid and hydroxyoctanoic acid, among which hydroxycaproic acid or glycolic acid is particularly preferred in terms of microbial degradability and cost economy.

The polylactic acid based polymers described above may be used either alone or in the form of a blend of two or more polymers selected therefrom. Where a blend of any of these polymers is used, the types of polymers to be blended, the blending ratio of the polymers and other blending conditions may be suitably determined in consideration of the spinnability and the like.

Where a polyalkylene dicarboxylate is employed as the aliphatic polyester, the polyalkylene dicarboxylate is preferably selected from the group consisting of polybutylene succinate, polyethylene succinate, polybutylene adipate and polybutylene sebacate, and copolymers essentially comprising a base unit of any of these polymers. Specifically, a copolymer comprising not less than 70 mol % of butylene succinate and any one of ethylene succinate, butylene adipate and butylene sebacate is preferred.

Where a poly-ω-hydroxyalkanoate is used as the aliphatic polyester, the poly-ω-hydroxyalkanoate is preferably selected from the group consisting of polycaprolactone and polypropiolactone, and copolymers essentially comprising a base unit of any of these polymers.

In the present invention, the biodegradable polymers described above may be used in the form of a blend of plural polymers selected therefrom.

Further, it is possible to use, as the biodegradable polymer, an aliphatic polyester amide copolymer which is a polycondensate of any of the aforesaid thermoplastic aliphatic polyesters and an aliphatic polyamide such as polycapramide (nylon 6), polytetramethylene adipamide (nylon 46), polyhexamethylene adipamide (nylon 66), polyundecanamide (nylon 11) or polylauramide (nylon 12).

It is preferred, in terms of the spinnability and the properties of the resulting filaments, that the biodegradable polymer has a number-average molecular weight of not less than about 20,000, preferably not less than 40,000, more preferably not less than 60,000. A polymer obtained by chain-extending any of the aforesaid polymers with the use of a small amount of a diisocyanate or a tetracarboxylic dianhydride for enhancement of the polymerization degree may be used as the biodegradable polymer. As required, various kinds of additives such as a dulling agent, a pigment and a nucleating agent may be added to the polymer, as long as the addition does not impair the intended effects of the present invention. In particular, the addition of a nucleating agent such as talc, boron nitride, calcium carbonate, magnesium carbonate or titanium oxide is preferable to prevent inter-filament adhesion (blocking) in the spinning and quenching process and to enhance crystallization in the thermoforming process for improvement of the heat resistance and mechanical strength of the resulting formed product. However, since excessive promotion of the filament crystallization will adversely affect the formability of the resulting nonwoven fabric, it is important that the amount of the nucleating agent to be added is within the range of 0.1 to 2.0 wt %, preferably 0.2 to 1.0 wt %.

The constituent filaments of the nonwoven fabric may have a solid cross-sectional configuration or any other cross-sectional configuration. It is particularly preferred that the filaments be of a hollow cross section, an odd-profile cross section, a sheath-core type composite cross section or a split type composite cross section.

Figure 2:
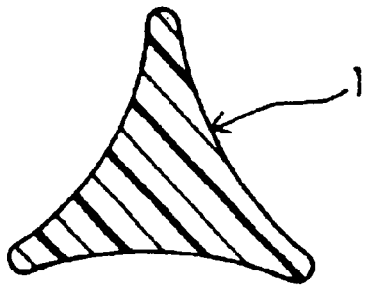
Figure 3:
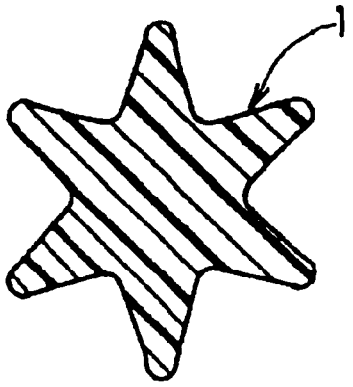
Figure 4:
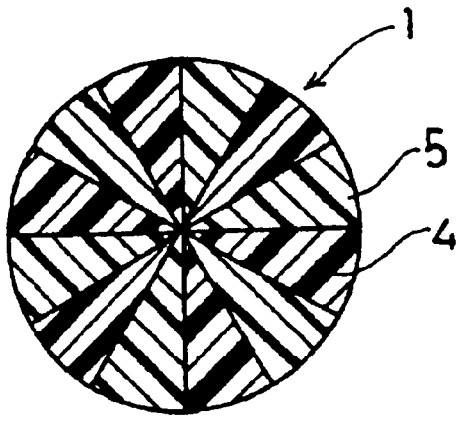
Figure 5:
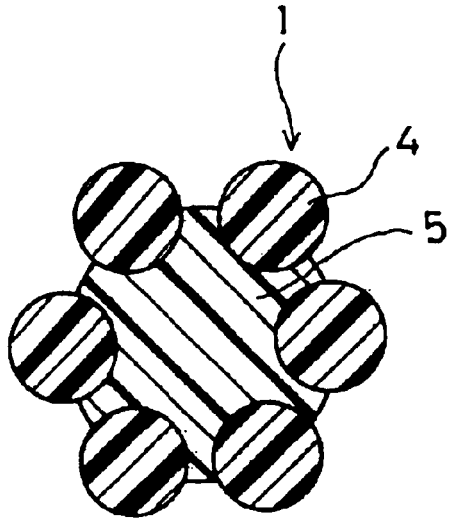
Figure 6:
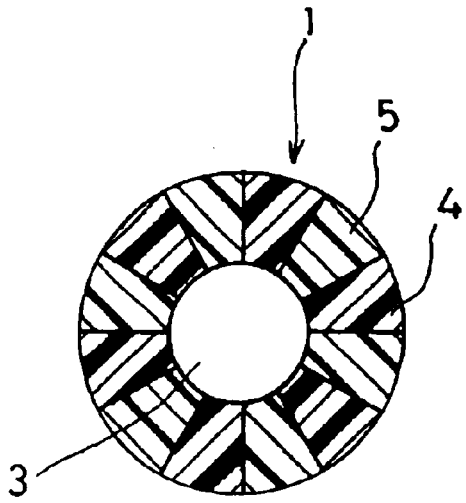

FIG. 1 is a sectional view of a filament 1 having a hollow cross-sectional configuration. Reference numerals 2 and 3 designate a filament portion and a hollow portion, respectively. Where a nonwoven fabric is composed of filaments having such a hollow cross-sectional configuration, the nonwoven fabric is imparted with a superior degradability. This is because, as microorganisms and moisture erode the filament portion 2 from the outer circumference thereof to reach the hollow portion 3, through-holes are formed in the filament portion 2 thereby to increase the surface area per unit polymer weight of the filament for enhancement of the microbial degradation rate. Further, the filament of the hollow cross-sectional configuration exhibits an improved quenchability in the spinning process, because the polymer weight of the filament passing through a quenching region in a unit time in the spinning process is relatively small and the filament contains therein an air column of a small specific heat capacity.

Where the filament has a polygonal or planar odd-profile cross-sectional configuration as shown in FIGS. 2 and 3, the filament exhibits an excellent quenchability in the spinning process and an excellent spreadability, and the resulting nonwoven fabric has an improved degradability. This is because the odd-profile filament also has a larger surface area per unit polymer weight.

Where the filament has a sheath-core type composite cross section, it is important that the filament of a sheath-core structure is composed of two kinds of filament components including at least one of a polylactic acid based polymer and a blend of plural kinds of polylactic acid based polymers with a core portion thereof being composed of one of the components which has a higher melting point (hereinafter referred to as "higher melting point component") and with a sheath portion thereof being composed of the other component which has a lower melting point (hereinafter referred to as "lower melting point component"). In this case, it is also important that a difference in the melting point between the two components is at least 5° C. or greater, preferably 10° C. or greater, more preferably 20° C. or greater. Where a blend of two or more kinds of polylactic acid based polymers is used for a core component and/or a sheath component, the determination of the melting point difference is based on the lowest one of the melting points of the blend constituent polymers for the core component and the highest one of the melting points of the blend constituent polymers for the sheath component. Thus, a web composed of such filaments can be bonded with heat and pressure at a relatively low temperature close to the melting point of the sheath component without fusing the higher melting point component of the core portion. Therefore, the resulting nonwoven fabric is imparted with an excellent flexibility.

Where the filament has a split type composite cross section, the resulting nonwoven fabric is imparted with an excellent degradability and flexibility. The term "split type composite cross section" herein refers to a filament cross section such that the filament is composed of two kinds of filament components including at least one of a polylactic acid based polymer and a blend of plural kinds of polylactic acid based polymers, and comprises plural segments of these two filament components which are splittable from each other and circumferentially arranged and each extend continuously along the length of the filament as being exposed to the exterior of the filament. Specifically, exemplary split type cross-sectional configurations are shown in FIGS. 4 to 6. More specifically, FIG. 4 shows a cross-sectional configuration wherein segments of a higher melting point component 4 and a lower melting point component 5 of a filament 1 are radially splittable from each other. FIG. 5 shows a cross-sectional configuration wherein a center portion of a filament 1 is composed of a lower melting point component 5 and a plurality of separate segments of a higher melting point component 4 are arranged circumferentially around the center portion of the lower melting point component 5 as protruding outwardly of the center portion. Where the filament has any of these filament cross-sectional configurations, splitting of the filament per se is accelerated by partial degradation of the segments, of a more degradable component (usually, lower melting point component). Therefore, the resulting nonwoven fabric is imparted with an improved degradability.

In FIG. 6, there is shown a filament cross-sectional configuration which is similar to the one shown in FIG. 4 but is different in that a hollow portion 3 is provided. Such a filament configuration provides for further improvement in the degradability, quenchability and spreadability of the filament. When a web composed of filaments of the split type composite cross section is bonded with heat and pressure, the fusion bonding of the web can be carried out at a temperature close to the melting point of the lower melting point component 5 without fusion of the higher melting point component 4. Therefore, the resulting nonwoven fabric is imparted with an excellent flexibility.

In addition to the filament cross-sectional configurations described above, a circular composite cross-sectional configuration or any of various odd-profile composite cross-sectional configurations such as triangular, quadrangular, hexagonal, planar, Y-shaped, and T-shaped cross-sectional configurations may be employed.

A web for the filament nonwoven fabric of the invention is partially bonded with heat and pressure without individual filaments being joined at their intersections, so that the web can retain a sheet-like nonwoven structure. The nonwoven fabric has an excellent flexibility because the constituent filaments are bonded to each other only in spot fusion-bonded areas partially formed in the web.

The single filament fineness of the constituent filaments of the nonwoven fabric is preferably not greater than 50 denier, more preferably 0.5 to 20 denier. If the fineness is greater than 50 denier, filament quenchability in the spinning process is impaired and, in addition, the resulting nonwoven fabric has a poor flexibility. Therefore, the nonwoven fabric fails to maintain a sufficient filament mobility during the thermoforming process, particularly, when subjected to a complicated acute-angle deforming process.

The nonwoven fabric of the present invention is composed of the filaments which satisfy the aforesaid requirement for the single filament fineness, and preferably has a weight per unit area of 10 to 500 g/M$^2$. If the weight per unit area is less than 10 g/M$^2$, the resulting nonwoven fabric is inferior in texture and mechanical strength, being unsatisfactory for practical use. A weight per unit area of greater than 500 g/M$^2$ is not preferable, because the resulting nonwoven fabric has a poor flexibility. In general, a fine nonwoven fabric has a greater denseness than a coarse nonwoven fabric even if they have the same weight per unit area. However, consideration should be given to the fact that the mechanical strength of the fine nonwoven fabric is deteriorated due to biodegradation in a shorter time. Where the mechanical strength of the filaments per se is low, the single filament fineness and the weight per unit area should be increased so that the nonwoven fabric can maintain a certain degree of strength.

The constituent filaments of the nonwoven fabric of the present invention should have a polymer supercool index of 0.3 to 0.6. The polymer supercool index represents the extensibility of the polymer at the thermoforming, and is defined by an equation to be described later. Only with the supercool index being within the aforesaid range, the filaments have a proper polymer molecular orientation and a low residual extensibility. Therefore, the resulting nonwoven fabric is imparted with an excellent deep drawing property, so that a product formed from the nonwoven fabric is superior in the mechanical strength and dimensional stability. If the supercool index is less than 0.3, constituent filaments of the resulting nonwoven fabric have an extremely low molecular orientation degree and an extremely high residual extensibility. Therefore, a product thermoformed from the nonwoven fabric is inferior in the mechanical strength and dimensional stability because of its high residual extensibility and low molecular orientation degree. On the contrary, if the supercool index is greater than 0.6, the polymer molecular orientation degree of the filaments is high, and the resulting nonwoven fabric has a lower residual extensibility. Such a nonwoven fabric is less liable to thermal deformation, so that the deep drawing thereof is difficult. Therefore, the nonwoven fabric may be torn in the forming process in the worst case, failing to provide a complete product.

The supercool index can be controlled in the following manner. In general, if the filaments are drafted at a higher drafting speed in the spinning process, the resulting filaments have a higher melting point and hence a lower crystallization temperature. The supercool index is reduced if the drafting speed is reduced, and increased if the drafting speed is increased. Therefore, the control of the supercool index can be achieved by increasing or reducing the drafting speed.

The filaments preferably have a birefringence of $3\times10^{-3}$ to $15\times10^{-3}$. The birefringence represents a polymer molecular orientation degree. Only with the birefringence being within the aforesaid range, the resulting filaments have a proper polymer molecular orientation, so that a product formed from the resulting nonwoven fabric is excellent in the mechanical strength and dimensional stability. If the birefringence is less than $3\times10^{-3}$, constituent filaments of the resulting nonwoven fabric have an extremely low molecular orientation degree; Therefore, a product thermoformed from the nonwoven fabric is inferior in the mechanical strength and dimensional stability because of its low molecular orientation degree. On the contrary, if the birefringence is greater than $15\times10^{-3}$, the polymer molecular orientation degree of the filaments is high, and the resulting nonwoven fabric has a lower residual extensibility. Such a nonwoven fabric is less liable to thermal deformation, so that the deep drawing thereof is difficult. Accordingly, the nonwoven fabric may be torn in the forming process in the worst case, failing to provide a complete product. Therefore, the birefringence is preferably $7\times10^{-3}$ to $13\times10^{-3}$.

The birefringence can be controlled in the following manner. The polymer molecular orientation degree increases, as a spinning tension applied to the polymer in the spinning process increases. The spinning tension depends upon the drafting speed. Therefore, an increase in the drafting speed increases the spinning tension, thereby increasing the molecular orientation degree and, hence, the birefringence. Although the birefringence can otherwise be increased by reducing the fineness of the filaments or by increasing a distance from a spinneret to a convergence point, the birefringence is most profoundly affected by the drafting speed.

A polymer crystalline size as measured axially of the filaments is preferably 15 to 20 Å. Only when the crystalline size measured axially of the filaments is within the aforesaid range, the filaments have a proper polymer molecular orientation and a low residual extensibility, so that a product formed from the resulting nonwoven fabric is excellent in the mechanical strength and dimensional stability. If the crystalline size is less than 15 Å, constituent filaments of the resulting nonwoven fabric have an extremely low molecular orientation degree and an extremely high residual extensibility. Therefore, a product thermoformed from the nonwoven fabric is inferior in the mechanical strength and dimensional stability because of its low molecular orientation degree and high residual extensibility. On the contrary, if the crystalline size is greater than 20 Å, the polymer molecular orientation degree of the filaments is high, and the resulting nonwoven fabric has a lower residual extensibility. Such a nonwoven fabric is less liable to thermal deformation, so that the deep drawing thereof is difficult. Accordingly, the nonwoven fabric may be torn in the forming process in the worst case, failing to provide a complete product. Therefore, the crystalline size measured axially of the filaments is preferably 16 to 20 Å.

Where a polylactic acid polymer having a melting point of higher than 100° C. is employed as the biodegradable polymer for the filaments, the resulting nonwoven fabric preferably has a boiling water shrinkage percentage of 10 to 40%. Where a nonwoven fabric has a boiling water shrinkage percentage of not smaller than 10%, the constituent filaments of the nonwoven fabric have a lower crystal orientation degree and a sufficient residual extensibility. Therefore, the nonwoven fabric is liable to thermal deformation and, hence, exhibits a superior extensibility at the thermal deformation, so that deep drawing thereof can properly be carried out. A boiling water shrinkage percentage of greater than 40% is not preferable because the constituent filaments of the nonwoven fabric have an extremely low molecular orientation degree and a product formed from the nonwoven fabric is inferior in the dimensional stability.

Therefore, the nonwoven fabric preferably has a boiling water shrinkage percentage of 15 to 40%.

In other words, the fact that the nonwoven fabric and the constituent filaments of the nonwoven fabric satisfy the aforesaid requirements means that the nonwoven fabric can be used as a material to be subjected to the thermoforming process. The nonwoven fabric exhibits a lower distortion stress and a higher breaking extension at a thermoforming temperature thereby to be prevented from tearing in the thermoforming process.

The filament nonwoven fabric of the present invention has a sheet-like nonwoven structure which is imparted thereto by heat treatment of the web of the constituent filaments.

One form of the nonwoven fabric is obtained by partially bonding the web with heat and pressure through a heat treatment. The constituent filaments are bonded to each other only in spot fusion-bonded areas partially formed in the nonwoven fabric, so that the nonwoven fabric has an excellent flexibility. The nonwoven fabric maintains a sufficient filament mobility in the thermoforming process, particularly when subjected to a complicated acute-angle deforming process, and exhibits an improved shape retaining property in the forming process.

Another form of the nonwoven fabric of the present invention has spot fusion-bonded areas in which some of temporary fusion-bonded spots preliminarily formed in parts of the web of the filaments are de-bonded through a three-dimensional entanglement process, and non-fusion areas in which the constituent filaments are three-dimensionally entangled with each other for integration of the filaments. More specifically, the nonwoven structure is obtained by preliminarily forming temporary fusion-bonded spots in parts of the web and subjecting the web to the three-dimensional entanglement process to de-bond at least some of the temporary fusion-bonded spots and three-dimensionally entangle the constituent filaments including the de-bonded filament portions. Thus, the resulting nonwoven fabric has an excellent flexibility and a mechanical strength and dimensional stability sufficient for practical use.

In further another form of the nonwoven fabric of the present invention, the constituent filaments are integrated by completely de-bonding temporary fusion-bonded spots once formed in parts of the web and three-dimensionally entangling the filaments through the three-dimensional entanglement process.

In still another form of the nonwoven fabric of the present invention, at least one surface of a filament web is preferably bonded with heat and pressure all over. The nonwoven fabric has a filmed surface portion and an inner nonwoven portion. The filmed surface portion imparts the nonwoven fabric with air-and water-shielding properties and a superior mechanical strength, while the inner nonwoven portion imparts the nonwoven fabric with a flexibility which is more excellent than an entirely filmed sheet. Therefore, the nonwoven fabric is a novel multi-function nonwoven fabric.

A method of producing the filament nonwoven fabric will hereinafter be described in detail.

The filament nonwoven fabric of the invention can efficiently be manufactured by the so-called spun bonding process. More specifically, a biodegradable polymer of any of the aforesaid types is melt-spun into filaments through a spinneret which provides a desired filament cross-sectional configuration. The filaments thus melt-spun are quenched by means of a known quenching device such as of lateral blow type or of annular blow type, and then drafted to the desired fineness by a suction device such as an air sucker in an air stream of 1,000 to 2,500 m/min. A filament mass discharged from the suction device is spread and then accumulated on a movable accumulator such as a screen conveyor for formation of a web. Then, the web formed on the movable accumulator is heat-treated to be formed into a nonwoven fabric.

The biodegradable polymer preferably has a melt flow rate (hereinafter referred to as "MFR") of 1 to 150 g/10 min as measured at 210° C. in conformity with the method specified in ASTM-D-1238. If the MFR is smaller than 1 g/10 min, the melt viscosity of the polymer is too high. Therefore, the efficiency of the drafting by the air sucker is reduced, and filament breakage is more likely to occur in the spinning process. If the MFR is greater than 150 g/10 min, the melt viscosity is too low, resulting in a poor stringiness. This makes it difficult to ensure stable operation.

The spinning temperature is properly determined in consideration of the type and MFR of the polymer and the like. If the spinning temperature is too low, the stringiness and draftability are reduced. On the other hand, if the spinning temperature is too high, interfilament adhesion and a poor filament spreadability may result, and thermal decomposition of the polymer per se may proceed.

In the spinning process, a quench air blow is applied to the spun filaments at a blow rate of not lower than a certain level that does not sway the filaments. The suction device is disposed below the spinneret. For improvement of the quenchability of the filaments, the aforesaid nucleating agent may be added to the polymer as required.

When the spun filaments are drafted by means of the suction device, it is important to adjust the drafting speed at 1,000 to 2,500 m/min as previously described. The drafting speed may properly be determined according to the MFR of the polymer and the end use of the nonwoven fabric. If the drafting speed is lower than 1,000 m/min, the orientation crystallization degree of the polymer is too low, so that the resulting nonwoven fabric tends to have a poor mechanical strength. On the other hand, if the drafting speed is higher than 2,500 m/min, the orientation crystallization is considerably promoted, so that the resulting nonwoven fabric exhibits a lower extensibility in the thermoforming process. In other words, the adjustment of the drafting speed at 1,000 to 2,500 m/min in the present invention ensures that the filaments has a proper polymer molecular orientation and a lower residual extensibility, and that the nonwoven fabric has a satisfactory deep-drawability and a product formed from the nonwoven fabric has a sufficient mechanical strength and dimensional stability, as described above. That is, the supercool index, birefringence and crystalline size of the polymer can be accommodated within the aforesaid ranges by adjusting the drafting speed within the aforesaid range.

For the heat treatment of the web, a partial bonding with heat and pressure can be employed, wherein spot fusion-bonded areas are formed through an embossing process or an ultrasonic fusion process. The working temperature for the bonding with heat and pressure, i.e., the surface temperature of an embossing roll, is preferably lower than the melting point of the polymer forming the web or, if the polymer is a blend of plural polymers, is lower than, the lowest one of the melting points of these polymers. If the temperature is higher than the melting point of the polymer, the polymer adheres onto a heat and press bonding apparatus, thereby considerably reducing the operability. In addition, the hardness of the resulting nonwoven fabric is increased, so that the nonwoven fabric has an inferior formability and a lower conformability to a complicatedly configured die.

The percentage of the fusion-bonded areas formed through the bonding with heat and pressure is preferably 3 to 50%. If the fusion-bonded area percentage is less than 3%, the resulting nonwoven fabric is inferior in the shape stability and dimensional stability in handling thereof. On the contrary, if the fusion-bonded area percentage is greater than 50%, the hardness of the resulting nonwoven fabric is increased, so that the nonwoven fabric has an inferior formability and a lower conformability to a complicatedly configured die.

The partial bonding with heat and pressure may be performed as part of a continuous process or as a separate process. A process to be employed may be determined in accordance with the type of products to be manufactured from the nonwoven fabric.

An ultrasonic fusion apparatus for the ultrasonic fusion process comprises an ultrasonic oscillator with an oscillation frequency of 20 kHz called "horn", and a pattern roll having projections of dot or band shape arranged circumferentially thereon. The pattern roll is disposed below the ultrasonic oscillator so that the web is passed through a clearance between the ultrasonic oscillator and the pattern roll for the partial fusion. The projections may be arranged in a row or a plurality of rows on the pattern roll. The plural rows of projections may be arranged in a parallel or staggered relation.

The nonwoven fabric of the present invention may have a structure such as obtained by preliminarily forming temporary fusion-bonded spots in parts of the web, and subjecting the web to the three-dimensional entanglement process to partially or completely de-bond the temporary fusion-bonded spots and to three-dimensionally entangle non-fusion-bonded portions of the filaments for integration of the filaments. An explanation will next be given to the production method for the nonwoven fabric having such a structure.

The web formed on the movable accumulator in the aforesaid manner is partially bonded with heat and pressure at a working temperature of (Tm−80)° C. to (Tm−10)° C. (wherein (Tm)° C is the lowest one of the melting points of the polymer components of the constituent filaments of the web) at a roll linear pressure of 10 to 100 kg/cm by means of a partially bonding apparatus with heat and pressure for formation of the temporary fusion-bonded spots in the web. Then, the resulting web is subjected to the three-dimensional entanglement process so as to de-bond at least some of the temporary fusion-bonded spots of the constituent filaments and to three-dimensionally and entirely entangle the filaments including the de-bonded-filament portions for integration thereof.

In this way, the preliminary partial bonding with heat and pressure allows for tentative shape retention of the web, so that the web has an improved shape retention property and mechanical strength which ensure easy handling of the web in the three-dimensional entanglement process to be thereafter performed. Since at least some of the temporary fusion-bonded spots are de-bonded through the three-dimensional entanglement process, the nonwoven fabric finally obtained has a greater proportion of non-fusion-bonded filament portions thereby to have an excellent flexibility. Where the temporary fusion-bonded spots are completely de-bonded through the three-dimensional entanglement process, the resulting nonwoven fabric is imparted with an excellent flexibility, while maintaining its nonwoven structure. On the other hand, where the temporary fusion-bonded spots are not completely de-bonded but some of the fusion-bonded spots are kept intact, the dimensional stability and mechanical strength of the nonwoven fabric can be ensured by the three-dimensional entanglement of the constituent filaments including the de-bonded filament portions, and further enhanced by the remaining fusion-bonded spots.

The fusion-bonded spots preliminarily formed by the partial bonding with heat and pressure each have an area of 0.2 to 15 $mm^2$, and the density of the fusion-bonded spots is 4 to 100 spots/$cm^2$, preferably 5 to 80 spots/$cm^2$. If the density of the fusion-bonded spots is lower than 4 spots/$cm^2$, no improvement is achieved in the mechanical strength and shape retaining property of the web after the bonding with heat and pressure. On the contrary, if the density of the fusion-bonded spots is higher than 100 spots/$cm^2$, the workability of the web in the three dimensional entanglement process is deteriorated. The fusion-bonded area percentage is preferably 3 to 50%, more preferably 4 to 40%. If the fusion-bonded area percentage is less than 3%, it is impossible to improve the dimensional stability of the resulting nonwoven fabric on the contrary, if the fusion-bonded area percentage is greater than 50%, the workability of the web in the three-dimensional entanglement process is reduced.

The aforesaid requirements for the working temperature and the roll linear pressure in the bonding with heat and pressure are particularly important. If the working temperature is lower than (Tm−80)° C. and/or if the roll linear pressure is lower than 10 kg/cm, the process of bonding with heat and pressure offers a poor effect, so that no improvement is achieved in the shape retaining property and mechanical strength of the resulting nonwoven fabric. On the contrary, if the working temperature is higher than (Tm−10)° C. and/or if the roll linear pressure is higher than 100 kg/cm, the effect offered by the bonding with heat and pressure is excessive, making it difficult to partially de-bond the fusion-bonded spots in the three-dimensional entanglement process. Therefore, the three-dimensional entanglement of the non-fusion-bonded filament portions cannot sufficiently be effected, making it difficult to integrate the filaments into the nonwoven structure.

The requirements thus specified for the working temperature and the roll linear pressure make it possible to preliminarily and partially form temporary fusion-bonded spots at contacts between the constituent filaments of the filament web. These temporary partially fusion-bonded spots improve the shape retaining property and mechanical strength of the web after the bonding with heat and pressure, and ensures easy handling of the web in the three-dimensional entanglement process to be thereafter performed. Further, the fusion-bonded spots each have a bonding strength such that at least some of the fusion-bonded spots can easily be de-bonded by a mechanical external force applied during the three-dimensionally entanglement process.

The three-dimensional entanglement process to be performed after the partial bonding with heat and pressure is achieved by a needle punching process or a pressurized liquid stream treatment process in which pressurized liquid streams are applied to the web.

Where the pressurized liquid stream treatment process is to be employed for the three-dimensional entanglement, the web produced by the spun bonding process and partially formed with the temporary fusion-bonded spots is placed on a moving perforated support plate as described above, and is exposed to pressurized liquid streams, whereby the filaments including the partially de-bonded filament portions are three-dimensionally entangled with each other for integration thereof.

To generate pressurized liquid streams, an apparatus is employed which includes an orifice head having a multiplicity of ejection orifices arranged at an interval of 0.3 to 10 mm in a row or plural rows, the ejection orifices each having an orifice diameter of 0.05 to 2.0 mm, preferably 0.1 to 0.4 mm. The apparatus ejects the pressurized liquid at an ejection pressure of 5 to 150 kg/$cm^2$G. If the pressure of the liquid streams is lower than 5 kg/$cm^2$G, it is difficult to partially debond the fusion-bonded spots, failing to sufficiently three-dimensionally entangle the constituent filaments with each other. On the contrary, if the pressure of the liquid streams is higher than 150 kg/$cm^2$G, the filaments are too densely entangled, so that the resulting nonwoven fabric tends to be less flexible. The ejection orifices are arranged in a row or plural rows perpendicularly to a web advancing direction. Where a plurality of rows of ejection orifices are provided, the ejection orifices are preferably arranged in a staggered relation for uniformly applying the pressurized liquid streams onto the web. Further, the apparatus may include a plurality of orifice heads each having ejection orifices. For the pressurized liquid stream treatment, it is common to use fresh water or warm water as the pressurized liquid. A distance between the ejection orifices and the web is preferably 1 to 15 cm. If the distance is less than 1 cm, the resulting nonwoven fabric has an irregular texture. On the contrary, if the distance is greater than 15 cm, the impact force of liquid streams exerted on the web is too small to ensure sufficient three-dimensional entanglement. The support base to be employed for supporting the web in the pressured liquid stream treatment process is, for example, a mesh screen such as 15- to 150-mesh wire net or a perforated plate, but not limited thereto as long as the pressurized liquid streams can penetrate through the web.

According to the end use of the nonwoven fabric as a product, filaments on both sides of, the web may tightly be integrated by subjecting one side of the web to the aforesaid entanglement process, then turning over the web, and subjecting the other side of the web to the entanglement process in the same manner by supplying pressured liquid streams. Thus, the resulting nonwoven fabric has an excellent dimensional stability and mechanical strength.

After the pressurized liquid stream treatment process, excess water should be removed from the treated web. The removal of the excess water can be achieved by any known method. For example, the excess water is mechanically removed to some extent by means of a squeezing device such as mangle roll, and residual water is removed by means of a dryer such as continuous hot air drier. The drying process may employ an ordinary dry heat treatment or, alternatively, a wet heat treatment as required. The treatment conditions such as treatment temperature and treatment time for the drying process may properly be determined not only for the water removal but also for impartation of moderate shrinkage to the nonwoven web.

Where the needle punching process is employed for the three-dimensional entanglement, the web produced by the spun bonding process and partially formed with the temporary fusion-bonded spots is punched through by punch needles, so that the filaments including at least partially de-bonded filament portions are three-dimensionally entangled with each other for integration thereof.

The needle punching process is preferably carried out under the conditions of a needle depth of 5 to 50 mm and a punching density of 50 to 400 punches/cm$^2$. If the needle depth is less than 5 mm, the entanglement degree of the filaments is small, resulting in a poor dimensional stability. A needle depth of more than 50 mm poses a problem associated with the productivity. If the punching density is smaller than 50 punches/cm$^2$, it is impossible to ensure smooth de-bonding of the fusion-bonded spots of the constituent filaments and sufficient entanglement of the filaments, so that the resulting nonwoven fabric has a poor dimensional stability. On the contrary, if the punching density is greater than 400 punches /cm$^2$, the filaments are cut by the punch needles, so that the resulting nonwoven fabric may have a reduced mechanical strength. The thickness, length, number of barbs, barb pattern and the like of each punch needle are properly selected according to the single filament fineness, intended use and the like of the nonwoven fabric.

The pressurized liquid stream treatment process described above is applicable to a web having a relatively low weight per unit area (15 to 200 g/m$^2$), providing a nonwoven fabric superior in the flexibility and mechanical strength. The needle punching process is applicable to a web having a relatively high weight per unit area (100 to 500 g/m$^2$), providing a nonwoven fabric superior in the flexibility, air permeability and water permeability. The selection of an applicable process is based on the weight per unit area because of a difference in the web penetrating ability between the pressurized liquid streams and the needle punches. Where the pressurized liquid stream treatment process is applied to a web of a high weight per unit area, for example, pressurized liquid streams do not penetrate through the thickness of the web, so that the uniform three-dimensional entanglement cannot be effected over the entire web but only in the surface layer of the web. Therefore, it is desirable that the selection of the applicable process is based on the weight per unit area of the nonwoven fabric and the application of the nonwoven fabric.

With this arrangement, fusion-bonded spots that have not been de-bonded through the three-dimensional entanglement process but remain intact in the spot fusion-bonded areas are present at a density of not greater than 20 spots/cm$^2$, preferably not greater than 10 spots/cm$^2$ with a fusion-bonded area percentage of not greater than 15%, preferably not greater than 10%. The constituent filaments in the filament nonwoven fabric having such spot fusion-bonded areas have efficiently been entangled with each other through the three-dimensional entanglement process due to the presence of a greater proportion of non-fusion-bonded filament portions. Thus, the nonwoven fabric exhibits an excellent dimensional stability and mechanical strength. Where the spot fusion-bonded areas partially remain in the web, the remaining spot fusion-bonded areas enhance the dimensional stability and mechanical strength of the nonwoven fabric. Since the temporary fusion-bonded spots are partially or completely de-bonded through the three-dimensional entanglement process as described above, the resulting nonwoven fabric has a greater proportion of non-fusion-bonded filament portions, exhibiting an excellent flexibility. At the same time, the nonwoven fabric is imparted with dimensional stability and mechanical strength by the three-dimensional entanglement of the non-fusion-bonded filament portions.

An explanation will next be given to a method of fabricating a nonwoven fabric according to the present invention, wherein at least one side of a web comprised of filaments is bonded with heat and pressure all over.

Prior to the all-over bonding with heat and pressure, a web formed on a movable accumulator may be subjected to a temporary partial bonding with heat and pressure, as required. After the temporary bonding with heat and pressure, the web may be subjected to the three-dimensional entanglement process for enhancement of the bulkiness of the web. Where the web continuously formed by the spun bonding process is tentatively wound, these processes prevent inter-web entanglement which otherwise makes it difficult to unwind the web. Therefore, the process of temporary bonding with heat and pressure to be performed for this purpose is merely required to impart the web with a tentative shape retaining ability for prevention of the entanglement at the web winding.

The all-over bonding of a web with heat and pressure is achieved by fusing the filaments in the surface and subsurface portions of the web by means of a heated metal roll having a smooth surface for filming the web surface.

The working temperature for the all-over bonding of a web with heat and pressure, i.e., the surface temperature of the metal roll should be a temperature not higher than (Tm−10)° C., wherein Tm° C. is the melting point of the polymer used. However, where the web to be subjected to the all-over bonding with heat and pressure is composed of filaments of a blend of two or more kinds of polylactic acid based polymers, or where the web is composed of bicomponent filaments having a composite cross-sectional configuration, e.g., a sheath-core type composite cross section or a split type composite cross section as earlier mentioned, the determination of the working temperature is based on the lowest one of the melting points of the polymer components of the blend or on the lower one of the melting points of the two polymer components of the composite filaments. If the working temperature is higher than the aforesaid temperature, the polymer adheres onto the heat and press bonding apparatus, thereby reducing the operability. In addition, the resulting nonwoven fabric has an unsatisfactory texture because of its coarseness and stiffness. Where only one side of the nonwoven fabric is to be subjected to the bonding with heat and pressure, one of a pair of rolls is kept at a temperature of not higher than (Tm−10)° C., and the other roll is kept at a temperature of not higher than (Tm−30)° C.

In the all-over bonding with heat and pressure, it is important to adjust the roll linear pressure at not lower than 0.01 kg/cm. If the roll linear pressure is lower than 0.01 kg/cm, the bonding with heat and pressure offers a poor effect, making it impossible to control the air and water shielding properties of the resulting nonwoven fabric. On the other hand, if the roll linear pressure is higher than 10 kg/cm, the effect offered by the bonding with heat and pressure is excessive, so that the resulting nonwoven fabric tends to be entirely filmed to have a coarse and stiff texture. Therefore, the roll linear pressure is preferably not higher than 10 kg/cm.

In the present invention, it is merely necessary to subject at least one side of the web to the bonding with heat and pressure. Particularly where both sides of the web are subjected to the bonding with heat and pressure, the resulting nonwoven fabric has a three-layer structure which consists of air- and water-impermeable film surface layers provided on its both sides and air-containing nonwoven layer provided therebetween. Thus, the nonwoven fabric has a superior heat retaining property.

The all-over bonding with heat and pressure may be performed as part of a continuous process or as a separate process.

As described above, the biodegradable filament nonwoven fabric of the present invention can be employed as a material to be thermoformed. An exemplary method of thermoforming the nonwoven fabric is such that the nonwoven fabric is press-formed in a die preheated at a temperature of not lower than the glass transition temperature and not higher than the melting point of a constituent polymer of the nonwoven fabric or, if the nonwoven fabric is composed of a plurality of polymers, at a temperature of not lower than the glass transition temperature and not higher than the melting point of a polymer having the highest melting point among the polymers, and then kept at a temperature close to the crystallization temperature of the polymer to promote the crystallization of the polymer for enhancement of the mechanical strength of the formed product.

DESCRIPTION OF EXAMPLES

The present invention will hereinafter be explained more specifically by way of the following examples. It is understood that the invention is in no way limited to these examples.

In the following examples and comparative examples, various physical property values were determined as stated below. MFR (g/10 min): The MFR was measured at 210° C. in accordance with the method specified in ASTM -D-1238. Melting Point (° C.) and Supercool Index: A fusion-endotherm curve was prepared on the basis of measurements obtained with a sample weight of 5 mg at a temperature rise rate of 20° C./min by means of a differential scanning calorimeter Model DSC-2 available from Perkin Elmer. In the fusion-endotherm curve, a middle temperature between a base line shift start temperature and a base line shift end temperature was defined as the glass transition temperature Tg (° C.), and an endothermic peak temperature was defined as a melting point Tm (° C.). Then, an exotherm curve was prepared on the basis of measurements obtained by cooling the sample at a temperature decrease rate of 20° C./min after being maintained in the melted state for 10 minutes. In the exotherm curve, an exothermic peak temperature was defined as a crystallization temperature Tc (° C.). Where two or more peaks were given, a main peak was employed. The supercool index was determined on the basis of the following expression.

Supercool Index=(Tm−Tc)/(Tm−Tg)

Weight per Unit Area (g/m$^2$): Ten specimens each having a 10-cm length and a 10-cm width were prepared from a sample in standard conditions. After each specimen was brought into moisture equilibrium, the weight (g) thereof was determined. The average of the weight values thus obtained was converted on a unit area basis for determination of the weight per unit area (g/m$^2$).

Air Permeability (cc/cm$^2$.sec): The air permeability was measured in accordance with the Frazir method specified in JIS-L-1096. More specifically, three specimens each having a 15-cm length and a 15-cm width were prepared from a sample, and a Frazir type tester was employed for the measurement. The specimens were each fitted on one end of a cylinder of the tester, and a suction pump was regulated by a rheostat so that a tilting type barometer gave a pressure reading of 12.7 mm water column. The amount (cc/cm$^2$.sec) of air passing through the specimen was determined on the basis of a pressure reading of a vertical barometer and the type of an air orifice used. The average of the air amount values thus obtained was employed as the air permeability.

Birefringence: The birefringence was measured by means of an interference microscope INTERFACO available from Carl Zeiss Yener Co. with the use of a mixture of liquid paraffin and α-bromonaphthalene as an encapsulant.

Crystalline size: The crystalline size was measured by a symmetrical transmission method by means of an X-ray generating apparatus Model MRP$^3$ available from Max Science Co. More specifically, a sample of unidirectionally aligned and bundled filaments was held vertically, and a Cu-K α-ray filtered by an Ni filter was directed toward the sample perpendicularly thereto. A diffraction intensity was measured with respect to a plane reflection which provided the highest intensity among the reflections along the axes of the filaments (c-axis). On the basis of the width B (radian) at half height of the diffraction peak, the crystalline size Dhkl was determined from the following Scherrer equation.

$$Dhkl=K\cdot\lambda/\beta\cos\theta$$

$$(\beta=(B^2-b^2)^{1/2})$$

wherein K is a constant (K=0.9), λ is the wavelength of the X-ray (λ=0.15418nm), θ is a Bragg angle, and b is a constant unique to the apparatus (Bcal=2.684/1000×2θ+0.9972).

Boiling Water Shrinkage Percentage: A specimen of 20 cm×20 cm was immersed in boiling water for 15 minutes, and then the area ($Xcm^2$) of the specimen was measured. The boiling water shrinkage percentage (%) was calculated from the following equation.

Boiling water shrinkage percentage=(400-X) X 100/400

Biodegradability: A sample of a nonwoven fabric was buried in a mature compost maintained at about 58° C. and taken out three months later. Where the nonwoven fabric sample did not have its original shape or, even if having its original shape, its tensile strength was lowered to not higher than 50% of its initial strength observed before the burial, the biodegradability of the nonwoven fabric sample was regarded acceptable. Where the tensile strength was higher than 50% of the initial strength observed before the burial, the biodegradability was regarded unacceptable.

Formability: Where a nonwoven fabric did not experience any extreme shrinkage when traveling along a forming process line nor any breakage during the forming process, the formability of the nonwoven fabric was regarded acceptable.

Example 1

A copolymer of L-lactic acid and D-lactic acid (L-lactic acid/D-lactic acid=99/1 mol %) having a melting point of 171° C. and an MFR of 40 g/10 min was employed. The copolymer was melt-spun into filaments through a circular spinneret at a spinning temperature of 200° C. at a mass out flow rate from each orifice of 0.33 g/min. The spun filaments were quenched by a conventional quenching device, and then drafted at 1,000 m/min by an air sucker. The filaments were spread open each other and accumulated on a collecting surface of a traveling conveyor thereby to be formed into a web. The web was then passed through a partially bonding apparatus with heat and pressure comprising embossing rolls so as to be partially bonded with heat and pressure under the following conditions: a roll temperature of 120° C.; a fusion-bonded area ratio of 7.6%; a fusion-bonded spot density of 20 spots/$cm^2$; and a linear pressure of a roll set of 50 kg/cm. Thus, a filament nonwoven fabric comprised of filaments of 3.0 denier in single filament fineness and having a weight per unit area of 70 g/$m^2$ was obtained. Further, the filament nonwoven fabric was subjected to the forming process. The production conditions and the physical properties, formability and biodegradability of the nonwoven fabric are shown in Table 1.

When the crystalline size of the polylactic acid filaments was determined, the highest intensity reflection among the reflections along the axes of the filaments (c-axis) was observed on the (0010) plane. A diffraction peak (diffraction angle: 2θ was observed at 31.5° which was employed for determination of the crystalline size.

Examples 2 to 4

Filament nonwoven fabrics and products formed therefrom according to Examples 2 to 4 were each obtained in substantially the same manner as in Example 1, except that the mass but flow rate from each orifice, the drafting speed and the embossing roll temperature were set as shown in Table 1 . The production conditions and the physical properties formability and biodegradability of the nonwoven fabrics are also shown in Table 1.

Example 5

A polybutylene succinate (number-average molecular weight: 50,000) having a melting point of 116° C. and an MFR of 30 g/10 min and containing 1 wt % of talk was employed. The polymer was melt-spun into filaments through a circular spinneret at a spinning temperature of 180° C. at a mass out flow rate from each orifice of 0.67 g/min. The spun filaments were quenched by a conventional quenching device, and then drafted at a drafting speed of 2,000 m/min by an air sucker. The filaments were spread open each other and accumulated on a traveling screen net thereby to be formed into a web. The web was then passed through a partially bonding apparatus with heat and pressure comprising embossing rolls so as to be partially bonded with heat and pressure under the following conditions: a roll temperature of 85° C.; and a fusion-bonded area ratio of 7.6%. Thus, a filament nonwoven fabric comprised of filaments of 3.0 denier in single filament fineness and having a weight per unit area of 70 g/$m^2$ was obtained. Further, the filament nonwoven fabric was subjected to the forming process. The production conditions and the physical properties, formability and biodegradability of the nonwoven fabric are shown in Table 1.

TABLE 1

| | Ex. 1 | Ex. 2 | Ex. 3 | Ex. 4 | Ex. 5 | Com. Ex. 1 | Com. Ex. 2 |
|---|---|---|---|---|---|---|---|
| Polymer | | | | | | | |
| MFR value (g/10 min) | 40 | 40 | 40 | 40 | 30 | 40 | 40 |
| Ratio of D-lactic acid in copolymer (mol %) | 1 | 1 | 1 | 1 | PBS*1 | 1 | 1 |
| Ratio of L-lactic acid in copolymer (mol %) | 99 | 99 | 99 | 99 | — | 99 | 99 |
| Melting point (° C.) | 171 | 171 | 171 | 171 | 116 | 171 | 171 |
| Production conditions | | | | | | | |
| Spinning temperature (° C.) | 200 | 200 | 200 | 200 | 180 | 200 | 200 |
| Filament sectional configuration | Circular mono-component | Circular mono-component | Circular mono-component | Circular mono-component | Circular mono-component | Circular mono-component | Circular mono-component |
| Single orifice throughput (g/min) | 0.33 | 0.50 | 0.67 | 0.83 | 0.67 | 0.17 | 1.33 |
| Drafting speed (m/min) | 1,000 | 1,500 | 2,000 | 2,500 | 2,000 | 500 | 4,000 |
| Emboss roll temperature (° C.) | 120 | 127 | 131 | 135 | 85 | 100 | 141 |
| Roll linear pressure (kg/cm) | 50 | 50 | 50 | 50 | 50 | 50 | 50 |
| Physical properties of nonwoven fabric | | | | | | | |
| Single filament fineness (denier) | 3.0 | 3.0 | 3.0 | 3.0 | 3.0 | 3.0 | 3.0 |
| Weight per unit area (g/$m^2$) | 70 | 70 | 70 | 70 | 70 | 70 | 70 |
| Supercool index | 0.32 | 0.41 | 0.50 | 0.54 | 0.43 | 0.15 | 0.75 |
| Birefringence index | 8.4 | 9.8 | 10.1 | 10.3 | 7.6 | 7.6 | 13.2 |
| Crystalline size | 15.5 | 26 | 33 | 40 | — | 4.8 | 64 |

TABLE 1-continued

| | Ex. 1 | Ex. 2 | Ex. 3 | Ex. 4 | Ex. 5 | Com. Ex. 1 | Com. Ex. 2 |
|---|---|---|---|---|---|---|---|
| Formability | Good | Good | Good | Good | Good | Good | Bad |
| Shrinkage before forming process (%) | 43.5 | 35.0 | 25.1 | 16.5 | — | 57.4 | 6.3 |
| Shrinkage after forming process (%) | 6.2 | 5.2 | 4.4 | 3.9 | — | 38.1 | — |
| Air permeability of formed product (cc/cm$^2$ sec) | 170 | 173 | 168 | 169 | 168 | 172 | 175 |
| Biodegradability | Good | Good | Good | Good | Good | Good | — |

*[1]PBS Polybutylene succinate 100 mol %

The formable nonwoven fabrics of Examples 1 to 5 each had a supercool index within the range specified in the present invention and, therefore, were superior in the formability. In addition, these nonwoven fabrics were superior in the biodegradability. During the spinning process of the filaments for the nonwoven fabrics of Examples 1 to 5, the filaments were free from inter-filament adhesion and filament breakage, and had a satisfactory filament spreadability.

Comparative Example 1

A filament nonwoven fabric and a product formed therefrom according to Comparative Example 1 were obtained in substantially the same manner as in Example 1, except that a mass out flowrate from each orifice of 0.17 g/min, a drafting speed of 500 m/min, and an embossing roll temperature of 100° C. were employed. The production conditions and the physical properties, formability and biodegradability of the nonwoven fabric are shown in Table 1.

Comparative Example 2

A filament nonwoven fabric and a product formed therefrom according to Comparative Example 2 were obtained in substantially the same manner as in Example 1, except that a mass out flowrate from each orifice of 1.33 g/min, a drafting speed of 4,000 m/min, and an embossing roll temperature of 141° C. were employed. The production conditions and the physical properties, formability and biodegradability of the nonwoven fabric are shown in Table 1.

In Comparative Example 1, the drafting speed was 500 m/min which was lower than the lower limit (1,000 m/min) specified in the present invention, and the supercool index was 0.15 which was lower than the lower limit (0.3) specified in the present invention. Therefore, the crystalline size of the polymer was excessively small, so that the nonwoven fabric and the product formed therefrom each exhibited an excessively great shrinkage. Accordingly, the nonwoven fabric was not suitable as a material to be formed. In Comparative Example 2, the drafting speed was 4,000 m/min which was higher than the higher limit (2,500 m/min) specified in the present invention, and the supercool index was 0.75 which was higher than the higher limit (0.6) specified in the present invention. Therefore, the nonwoven fabric was inferior in the formability, so that the nonwoven fabric was torn during the forming process, failing to provide an intended formed product. However, during the spinning process of the filaments for the nonwoven fabrics of comparative examples 1 and 2, the filaments were free from inter-filament adhesion and filament breakage, and had a satisfactory spreadability.

What is claimed is:

1. A thermoformable nonwoven fabric composed of filaments of a biodegradable polymer, wherein the biodegradable polymer is a copolymer of D-lactic acid and L-lactic acid in which the copolymerization molar ratio of either one of D-lactic acid in which the copolymerization molar ratio of either one of D-lactic acid and L-lactic acid is 90% or more and that of the other is 10% or less, the nonwoven fabric is a spun bonded nonwoven fabric in which the filaments are bonded to each other only in spot fusion-bonded areas partially formed in the nonwoven fabric, the filaments have a polymer supercool index of 0.3 to 0.6, the filaments have a birefringence of $3\times10^{-3}$ to $15\times10^{-3}$, the filaments have a polymer crystalline size of 15 to 20 angstroms as measured axially thereof, and the nonwoven fabric has a boiling water shrinkage percentage of 10 to 40%.

2. The nonwoven fabric as set forth in claim 1 wherein the polymer contains a nucleating agent.

3. A product thermoformed from the nonwoven fabric according to claim 1.

4. The product as set forth in claim 3, wherein the nonwoven fabric of the thermoformed product has a boiling water shrinkage percentage of 3.9 to 6.2%.

5. A thermoformable nonwoven fabric composed of filaments of a biodegradable polymer, wherein the biodegradable polymer is a copolymer of D-lactic acid and L-lactic acid in which the copolymerization molar ration of either one of D-lactic acid and L-lactic acid is 90% or more and that of the other is 10% or less, the nonwoven fabric is a spun bonded nonwoven fabric and has temporary fusion-bonded spots preliminarily formed in parts of a web of the filaments in which the filaments are partially de-bonded through a three-dimensional entanglement process, and non-fusion areas in which the filaments are three-dimensionally entangled with each other for integration of the filaments, the filaments have a polymer supercool index of 0.3 to 0.6, the filaments have a birefringence of $3\times10^{-3}$ to $15\times10^{-3}$, the filaments have a polymer crystalline size of 15 to 20 angstroms as measured axially thereof, and the nonwoven fabric has a boiling water shrinkage percentage of 10 to 40%.

6. The nonwoven fabric as set forth in claim 5, wherein the polymer contains a nucleating agent.

7. A product thermoformed from the nonwoven fabric according to claim 5.

8. The product as set forth in claim 7, wherein the nonwoven fabric of the thermoformed product has a boiling water shrinkage percentage of 3.9 to 6.2%.

9. A thermoformable nonwoven fabric composed of filaments of a biodegradable polymer, wherein the biodegradable polymer is a copolymer of D-lactic acid and L-lactic acid in which the copolymerization molar ratio of either one of D-lactic acid and L-lactic acid is 90% or more and that of the other is 10% or less.

the nonwoven fabric is a spun bonded nonwoven fabric, and the filaments are integrated by completely de-bonding temporary fusion-bonded spots once formed in parts of a web of the filaments and three-dimensionally entangling the filaments through a three-dimensional entanglement process, the filaments have a polymer supercool index of 0.3 to 0.6, the filaments have a birefringence of $3\times10^{-3}$ to $15\times10^{-3}$, the filaments have a polymer crystalline size of 15 to 20 angstroms as measured axially thereof, and the nonwoven fabric has a boiling water shrinkage percentage of 10 to 40%.

10. The nonwoven fabric as set forth in claim 9, wherein the polymer contains a nucleating agent.

11. A product thermoformed from the nonwoven fabric according to claim 9.

12. The product as set forth in claim 11, wherein the nonwoven fabric of the thermoformed product has a boiling water shrinkage percentage of 3.9 to 6.2%.

* * * * *